US006825603B2

(12) United States Patent
Park

(10) Patent No.: US 6,825,603 B2
(45) Date of Patent: Nov. 30, 2004

(54) DEFLECTION YOKE STRUCTURE FOR CATHODE RAY TUBE

(75) Inventor: Jeong Ho Park, Gyeongsan-si (KR)

(73) Assignee: LG. Philips Displays Korea Co., Ltd., Gyeongsangbuk-do (KR)

( * ) Notice: Subject to any disclaimer, the term of this patent is extended or adjusted under 35 U.S.C. 154(b) by 172 days.

(21) Appl. No.: 10/347,249

(22) Filed: Jan. 21, 2003

(65) Prior Publication Data

US 2003/0137232 A1 Jul. 24, 2003

(30) Foreign Application Priority Data

Jan. 22, 2002 (KR) ..... 10-2002-3565

(51) Int. Cl.[7] ..... H01J 29/70

(52) U.S. Cl. ..... 313/440; 313/421; 313/426; 313/413; 335/210; 335/212; 335/213

(58) Field of Search ..... 313/440, 421, 313/426, 412, 413, 428; 335/210, 211, 212, 213

(56) References Cited

U.S. PATENT DOCUMENTS

| | | | | |
|---|---|---|---|---|
| 5,099,169 A | | 3/1992 | Vriens | 313/403 |
| 5,465,026 A | * | 11/1995 | Roussel et al. | 313/440 |
| 5,945,779 A | * | 8/1999 | Inoue et al. | 313/440 |
| 5,962,964 A | | 10/1999 | Sano et al. | 313/440 |
| 6,087,768 A | | 7/2000 | Beirens | 313/442 |
| 2002/0140337 A1 | | 10/2002 | Kim et al. | 313/346 R |

FOREIGN PATENT DOCUMENTS

| | | |
|---|---|---|
| EP | 1 265 265 A2 | 12/2002 |
| EP | 1 265 265 A3 | 12/2002 |
| JP | 63-266737 A | 11/1988 |
| JP | 10-223155 A | 8/1998 |
| JP | 11-120935 A | 4/1999 |
| JP | 12-265668 A | 9/1999 |
| JP | 2001-155661 A | 6/2001 |

* cited by examiner

*Primary Examiner*—Joseph Williams
*Assistant Examiner*—Kevin Quarterman
(74) *Attorney, Agent, or Firm*—Birch, Stewart, Kolasch & Birch, LLP

(57) ABSTRACT

The present invention relates to a cathode ray tube having a deflection yoke including a circular ferrite core and a deflection coil whose cross-section is in a rectangular shape for improving a deflection sensitivity of the cathode-ray tube, and more particularly to a cathode ray tube, in which one part of a vertical deflection coil having a rectangular shaped cross-section to improve a lead-in capability when winding the vertical deflection coil located between a ferrite core and the holder is separated by a predetermined gap from a holder that isolates a horizontal deflection coil and the vertical deflection coil.

7 Claims, 13 Drawing Sheets

FIG. 10

| X | X/(Y−Z) | Vertical deflection energy(%) | Resistance(%) | Current$^2$ (%) |
|---|---|---|---|---|
| Y−Z | 1.00 | 147.14 | 123.26 | 119.36 |
| | 0.83 | 135.62 | 116.85 | 116.06 |
| | 0.67 | 126.83 | 112.29 | 112.94 |
| | 0.50 | 120.00 | 108.96 | 110.12 |
| | 0.33 | 113.65 | 105.83 | 107.39 |
| | 0.17 | 107.62 | 102.97 | 104.51 |
| 0 | 0.00 | 100.00 | 100.00 | 100.00 |

DEFLECTION YOKE STRUCTURE FOR CATHODE RAY TUBE

BACKGROUND OF THE INVENTION

1. Field of the Invention

The present invention relates to a cathode ray tube having a deflection yoke including a circular ferrite core and a deflection coil whose cross-section is in a rectangular shape for improving a deflection sensitivity of the cathode-ray tube, and more particularly to a cathode ray tube, in which one part of a vertical deflection coil having a rectangular shaped cross-section to improve a lead-in capability when winding the vertical deflection coil located between a ferrite core and the holder is separated by a predetermined gap from a holder that isolates a horizontal deflection coil and the vertical deflection coil 2. Background of the Related Art FIG. 1 is a diagram illustrating a conventional cathode ray tube.

Referring to FIG. 1, the conventional cathode ray tube includes an electron gun 4 for emitting three electron beams, a fluorescent screen 1 on which a fluorescent substance is formed for colliding with the electron beams to generate lights, a shadow mask 2 for performing dichroic operations of the three electron beams, and a deflection yoke 3 for allowing the electron beams to be deflected at predetermined locations on the fluorescent screen 1.

In particular, the deflection yoke 3 includes a horizontal deflection coil 31 for deflecting the electron beam emitted from the electron gun 4 installed in the cathode ray tube in the horizontal direction, a vertical deflection coil 33 for deflecting the electron beam in the vertical direction, a conic shaped ferrite core 34 for improving a magnetic efficiency by minimizing the loss of a magnetic force being generated from the horizontal deflection coil 31 and vertical deflection coil 33, and a holder 32 for fixing the vertical deflection coil 33, the horizontal deflection coil 31 and the ferrite core 34 at predetermined locations and isolating the horizontal deflection coil 31 and the vertical deflection coil 33.

In addition, in a neck part of the deflection yoke 3 are formed a convergence yoke 35 for compensating a misconvergence due to an error of the manufacture process of the deflection yoke and the cathode ray tube, and a pair of ring-shape permanent magnets 36.

FIG. 2 is a diagram illustrating an assembly process of the conventional cathode ray tube.

To give a brief description on the cathode ray tube with reference to FIG. 2, the horizontal deflection coil is installed in the inner part of the holder 32, and the vertical deflection coil 33 is installed in the outer part of the holder 32.

Then, the ferrite core 34 is provided in a manner to wind around the outer surface of the vertical deflection coil 33.

The conventional deflection yoke 3 allows a current having at least 15.75 kHz frequency to flow to the horizontal deflection coil 31 and deflects the electron beam in the cathode ray tube in the horizontal direction using a magnetic field generated by the current.

Also, the deflection yoke 3 allows a current having a 60 Hz frequency to flow to the vertical deflection coil 33 and deflects the electron beam in the vertical direction using a magnetic field generated by the current.

A self-convergence type deflection yoke 3 for allowing three electron beams to compensate for a convergence on a screen without using separate additional circuit and additional device by using a nonuniform magnetic field generated by the horizontal deflection coil 30 and vertical deflection coil 33, has been developing.

That is, by controlling a winding distribution of the horizontal deflection coil 31 and vertical deflection coil 33 and forming a barrel type or pin-cushion type magnetic field in respective regions (opening region, intermediate region and neck region), it is possible to have different deflection forces corresponding to locations of the three electron beams affect the electron beams, and therefore the electron beams converge on the same point though the respective electron beams have respective distances from beginning points to arrival points.

Also, in the case that a magnetic field is formed by flowing a current to the horizontal deflection coil 31 and the vertical deflection coil 33, the magnetic field generated by the horizontal deflection coil 31 and the vertical deflection coil 33 is not strong enough to deflect the electron beams to the whole surface of the screen. Hence the ferrite core 34 having a high magnetic permeability is used to minimize a loss on a feedback path of the magnetic field, thereby improving an efficiency of the magnetic field and increasing a magnetic force. FIG. 3*a* is a cross-sectional view of a conventional deflection yoke including a deflection coil, whose cross-section being in a rectangular shape, and a rectangular shaped ferrite core. FIG. 3*b* shows a deflection coil having a rectangular shaped cross-section and a circular ferrite core.

Referring to FIGS. 3*a* and 3*b*, when three electron beams pass through a magnetic field area, according to Fleming's left hand rule, a force applied to each of the three electron beams is deflected, being inversely proportional to the cube of the distance between the inner surface of the deflection coil and the electron beam. As shown in FIG. 3*a*, because the deflection yoke including the deflection coil 33 and ferrite core 34 having the rectangular shapes respectively is closer to the electron beams than the deflection yoke having the circular deflection coil and the ferrite core, a deflection sensitivity can be improved.

Accordingly, in the case of the deflection yoke including the horizontal deflection coil and vertical deflection coil whose cross-sections are in rectangular shapes, the distance between the electron beam and the deflection coil is shorter by 20% than the conventional deflection yoke including the deflection coil whose cross-section is the circular shape. As a result, horizontal and vertical deflection sensitivities are greatly improved by 20–30%.

Also, given that the deflection coil 33 whose cross-section is the rectangular shape and the inexpensive circular ferrite core 34 as shown in FIG. 3*b* are used, it is now possible to improve the deflection sensitivity and obtain enhanced cost reduction efficiency.

FIG. 4 shows a state how a conventional horizontal deflection coil whose cross section is a rectangular shape is wounded, and FIG. 5 shows a state how a conventional vertical deflection coil whose cross-section is the rectangular shape is wounded.

Referring to FIGS. 4 and 5, the horizontal deflection coil 31 and the vertical deflection coil 33 are leaded-in and formed in a space between an upper former 20 and a lower former 21. Because the horizontal deflection coil 31, as shown in FIG. 4, is wound on the farther side of a former center line 40, that is, beneath a diagonal line 41, a distance which the horizontal deflection coil 31 must be leaded in from an entrance is short.

However, a relatively large number of vertical deflection coils 33, as shown in FIG. 5, are located closer to the former center line 40, that is, beneath the diagonal line 41 due to the deflection yoke property.

Accordingly, because the vertical deflection coil 33 must be leaded-in from the entrance toward the former center line 40, the vertical deflection coil 33 is subjected to a great frictional force over the long distance in the course of winding.

Also, because the former surface of the vertical deflection coil 33 whose cross-section is the rectangular shape is bended almost perpendicularly in the vicinity of the diagonal line 41, the frictional force becomes greater between the vertical deflection coil 33 and the former surface than a vertical deflection coil with a circular cross-section and the circular former surface.

Therefore, a problem arises in that the vertical deflection coil 33 whose cross-section is the rectangular shape has a poor lead-in capability upon winding.

FIG. 6 shows a cross-sectional diagram of a deflection yoke in a cathode ray tube having a screen ratio of 16:9.

As shown in FIG. 6, in case that the screen ratio is 16:9 not 4:3, the horizontal direction length of a vertical deflection coil 33 is longer than that of a vertical deflection coil of a cathode ray tube having a screen ratio of 4:3. As such, a lead-in capability of the vertical deflection coil 33 becomes worse.

SUMMARY OF THE INVENTION

An object of the invention is to solve the above problems and/or disadvantages of the prior art.

Accordingly, one object of the present invention is to provide a deflection coil whose cross-section is a rectangular shape for improving a deflection sensitivity, thereby enhancing a productivity of the deflection coil as well as facilitating a manufacture of the deflection coil.

The present invention relates to a cathode ray tube having a deflection yoke including a circular ferrite core and a deflection coil whose cross-section is a rectangular shape for improving a deflection sensitivity of the cathode-ray tube, and more particularly to a cathode ray tube, in which one part of a vertical deflection coil whose cross-section is a rectangular shape is separated by a predetermined gap from a holder, for improving a lead-in capability when the vertical deflection coil is wound, wherein the vertical deflection coil is located between a ferrite core and the holder for isolating a horizontal deflection coil and the vertical deflection coil.

The cathode ray tube according to the present invention has a deflection yoke including a horizontal deflection coil for deflecting an electron beam being emitted from an electron gun in a horizontal direction, a vertical deflection coil for deflecting the electron beam in a vertical direction, a ferrite core for preventing a loss of a magnetic force generated from the horizontal deflection coil and vertical deflection coil and improving a magnetic efficiency, and a holder for fixing the horizontal deflection coil, the vertical deflection coil and the ferrite core at predetermined locations and isolating between the horizontal deflection coil and the vertical deflection coil, wherein each cross-section of the horizontal deflection coil and the vertical deflection coil has a rectangular shape and a cross-section of the ferrite core has a circular shape, and in the case that an distance from an outer part of the holder to an inner surface of the ferrite core on a vertical axis of a cross-section of the deflection yoke taken along a plane parallel to a panel from an opening end of the ferrite core, is defined as Y, an distance from the outer part of the holder to the inner surface of the vertical deflection coil on the vertical axis is defined as X, and a thickness of the vertical deflection coil 33 on the vertical axis is defined as Z, the distance X from the outer part of the holder to the inner surface of the vertical deflection coil on the vertical axis satisfies a relationship of $0<X<Y-Z$.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail in reference to the following drawings in which like reference numerals refer to like elements wherein:

FIG. 10 is a chart illustrating aggravation levels of a vertical deflection energy when an distance X from the outer surface of a holder to the inner surface of the vertical deflection coil is changed on the vertical axis of the cathode ray tube in accordance with the present invention;

DETAILED DESCRIPTION OF PREFERRED EMBODIMENTS

A cathode ray tube according to the present invention has a deflection yoke including a horizontal deflection coil for deflecting an electron beam being emitted from an electron gun in a horizontal direction, a vertical deflection coil for deflecting the electron beam in a vertical direction, a ferrite core for preventing a loss of a magnetic force generated from the horizontal deflection coil and the vertical deflection coil and improving a magnetic efficiency, and a holder for fixing the horizontal deflection coil, the vertical deflection coil and the ferrite core at predetermined locations and isolating between the horizontal deflection coil and the vertical deflection coil, wherein each cross-section of the horizontal deflection coil and the vertical deflection coil has a rectangular shape and a cross-section of the ferrite core has a circular shape, and in the case that an distance from an outer part of the holder to an inner surface of the ferrite core is defined as Y, on a vertical axis of a cross-section of the deflection yoke taken along a plane parallel to a panel from an opening end of the ferrite core, an distance from the outer part of the holder to the inner surface of the vertical deflection coil on the vertical axis is defined as X, and a thickness of the vertical deflection coil 33 on the vertical axis is defined as Z, the distance X from the outer part of the holder to the inner surface of the vertical deflection coil on the vertical axis satisfies a relationship of $0<X<Y-Z$.

The following detailed description will present a cathode ray tube according to a preferred embodiment of the invention in reference to the accompanying drawings.

Figure 7:
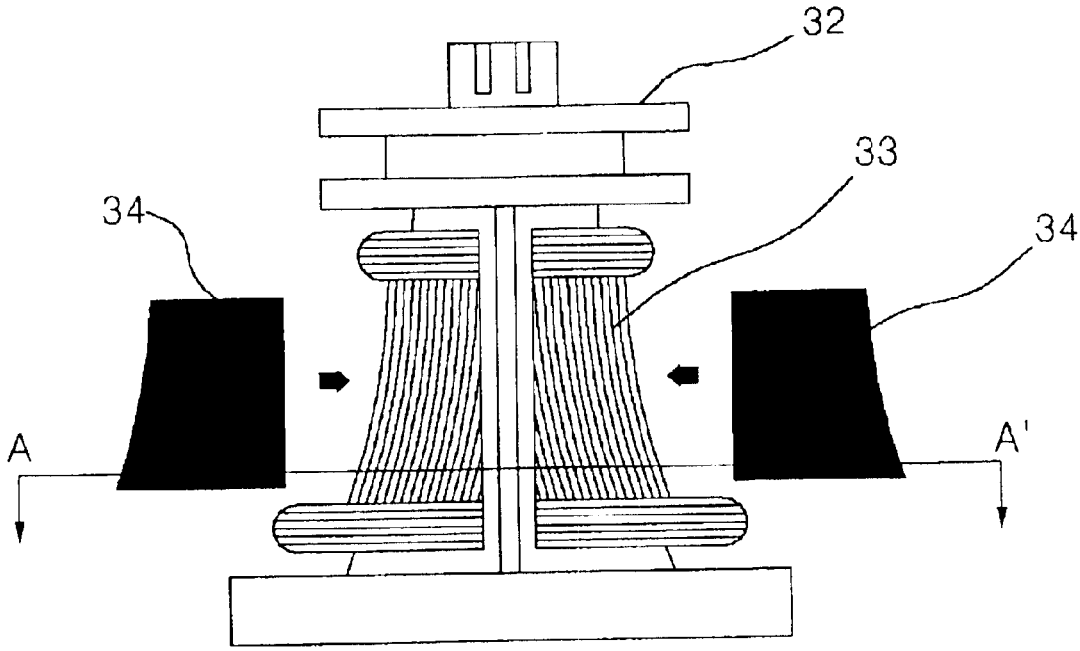
FIG. 7 is a cross-sectional diagram illustrating how a deflection coil whose cross-section is a rectangular shape and a circular ferrite core in a cathode ray tube are coupled to each other in accordance with the present invention.
Figure 8:
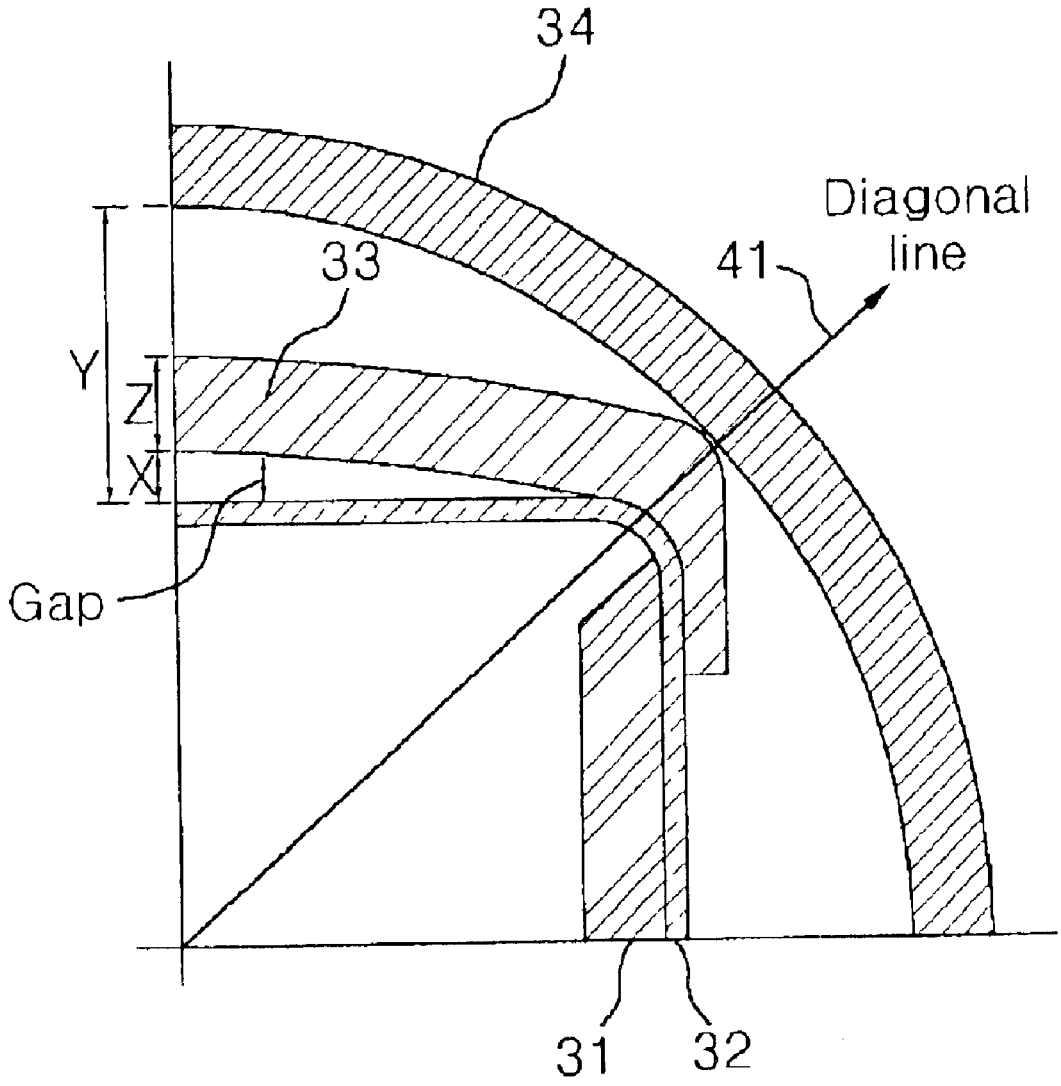
FIG. 8 is a cross-sectional diagram of the deflection coil (taken along line A-A' of FIG. 7) in the cathode ray tube in accordance with the present invention.

FIG. 7 is a diagram illustrating a coupled state of a deflection coil whose cross-section is a rectangular shape and a circular ferrite core in a cathode ray tube in accordance with the present invention, and FIG. 8 is a cross-sectional diagram of the deflection coil (taken along line A-A' of FIG. 7) in the cathode ray tube in accordance with the present invention.

As described in reference to FIGS. 7 and 8, the cathode ray tube according to the present invention has a deflection yoke including a horizontal deflection coil for deflecting an electron beam being emitted from an electron gun in a horizontal direction, a vertical deflection coil for deflecting the electron beam in a vertical direction, a ferrite core for preventing a loss of a magnetic force generated from the horizontal deflection coil and the vertical deflection coil and improving a magnetic efficiency, and a holder for fixing the horizontal deflection coil, the vertical deflection coil and the ferrite core at predetermined locations and isolating between the horizontal deflection coil and the vertical deflection coil, wherein each cross-section of the horizontal deflection coil and the vertical deflection coil has a rectangular shape and a cross-section of the ferrite core has a circular shape, and in the case that an distance from an outer part of the holder to an inner surface of the ferrite core is defined as Y, on a vertical axis of a cross-section of the deflection yoke taken along a plane parallel to a panel from an opening end of the ferrite core, an distance from the outer part of the holder to the inner surface of the vertical deflection coil on the vertical axis is defined as X, and a thickness of the vertical deflection coil 33 on the vertical axis is defined as Z, the distance X from the outer part of the holder to the inner surface of the vertical deflection coil on the vertical axis satisfies a relationship of $0<X<Y-Z$.

The ferrite core 34 includes a circular ferrite core which has been used in general and a rectangular shape of ferrite core. As described in detail, the present invention relates to a cathode ray tube having a deflection yoke adopting a circular ferrite core 34 and a rectangular shape of vertical deflection coil 33.

As shown in FIG. 8, the holder 32 on the vertical axis and the vertical deflection coil 33 are separated by a predetermined gap in the upper part of the diagonal line 41 in a view of the cross-section of the deflection yoke.

In FIG. 8, the distance from the outer part of the holder 32 to the inner surface of the ferrite core 34 on the vertical axis is defined as Y, the distance from the outer part of the holder 32 to the inner surface of the vertical deflection coil 33 on the vertical axis is defined as X, and the thickness of the vertical deflection coil 33 on the vertical axis is defined Z.

It is desirable that the distance X from the outer part of the holder 32 to the inner surface of the vertical deflection coil 33 on the vertical axis is 0 in order to improve a deflection sensitivity. However, this often causes a problem during the manufacture process thereof.

Figure 9:
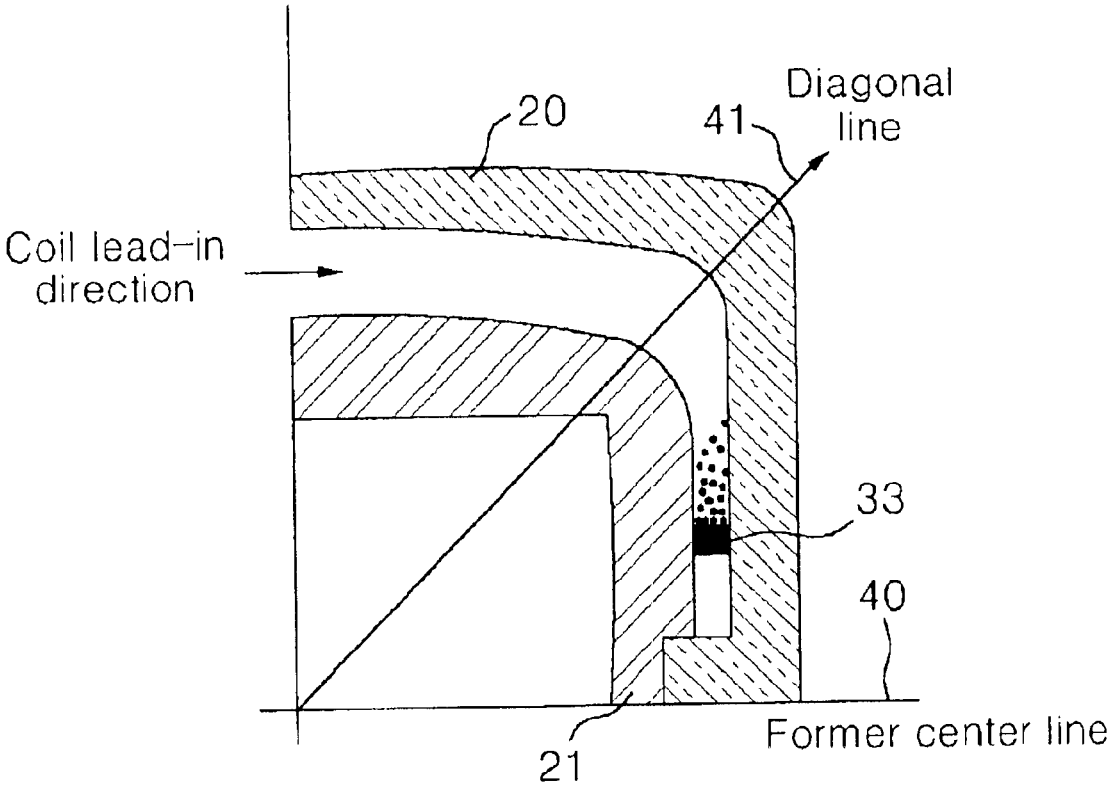
FIG. 9 shows a winding of a vertical deflection coil in the cathode ray tube in accordance with the present invention.

FIG. 9 shows a winding of the vertical deflection coil in the cathode ray tube in accordance with the present invention.

As described in reference to FIGS. 8 and 9, the vertical deflection coil 33 is produced from a former consisting of an upper former 20 and a lower former 21. Due to a predetermined distance X from the outer part of the holder 32 to the inner surface of the vertical deflection coil 33 on the vertical axis, the vertical deflection coil 33 is leaded-in much more gently than the conventional art.

Figure 1:
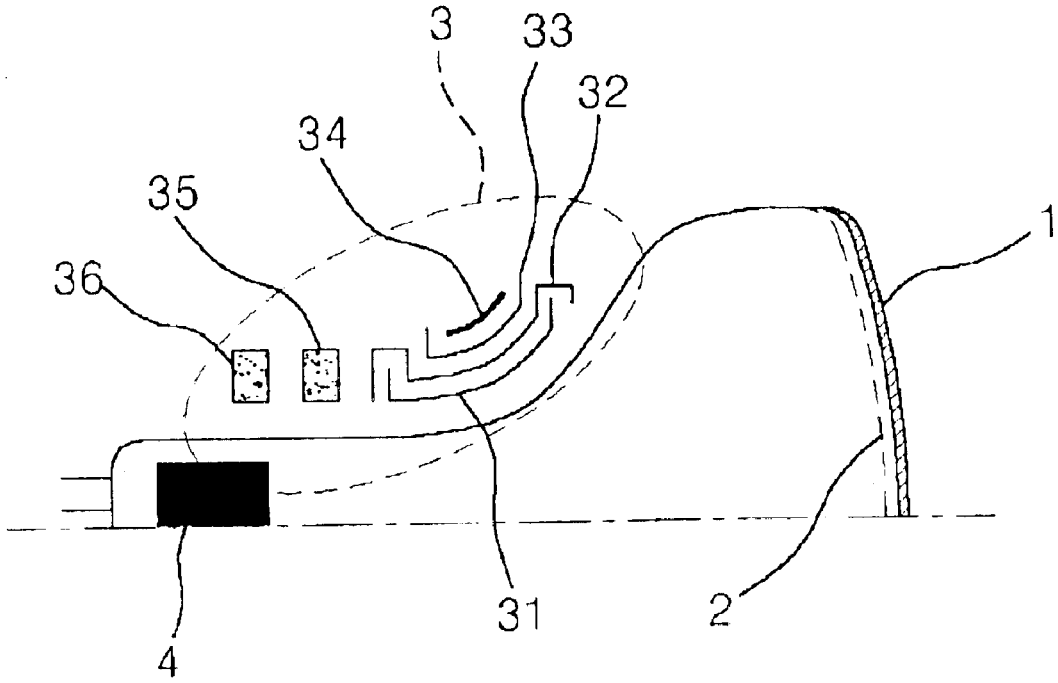
FIG. 1 (Related Art)
FIG. 1 is a partial cross-sectional view illustrating a conventional cathode ray tube.
Figure 2:
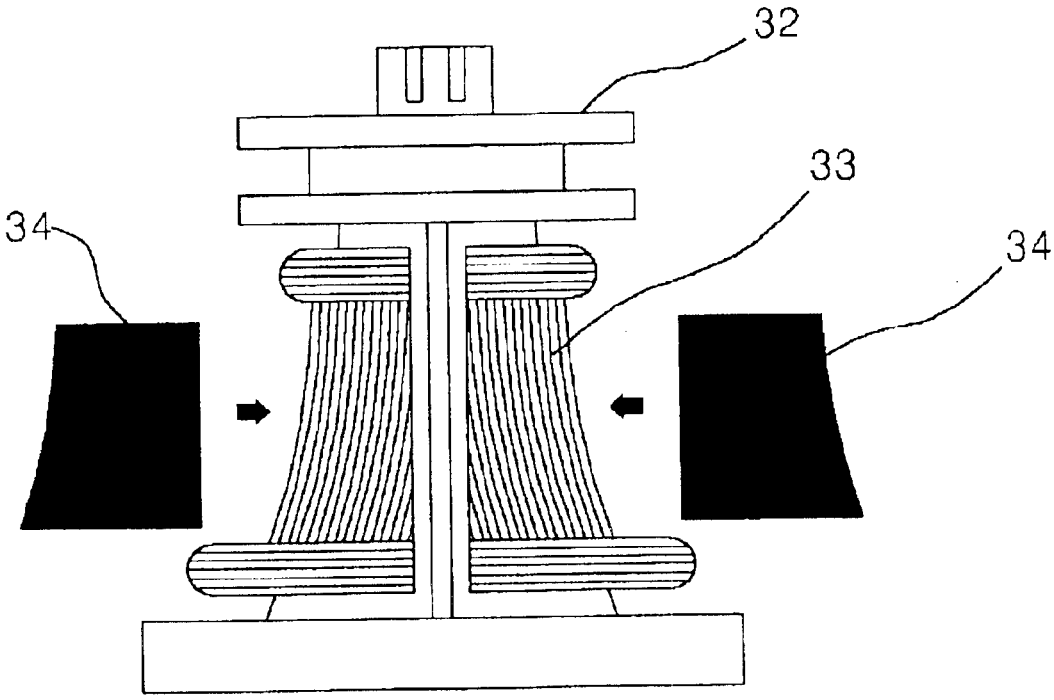
FIG. 2 (Related Art)
FIG. 2 is a cross-sectional diagram illustrating an assembly process of the conventional cathode ray tube.
Figure 3A:
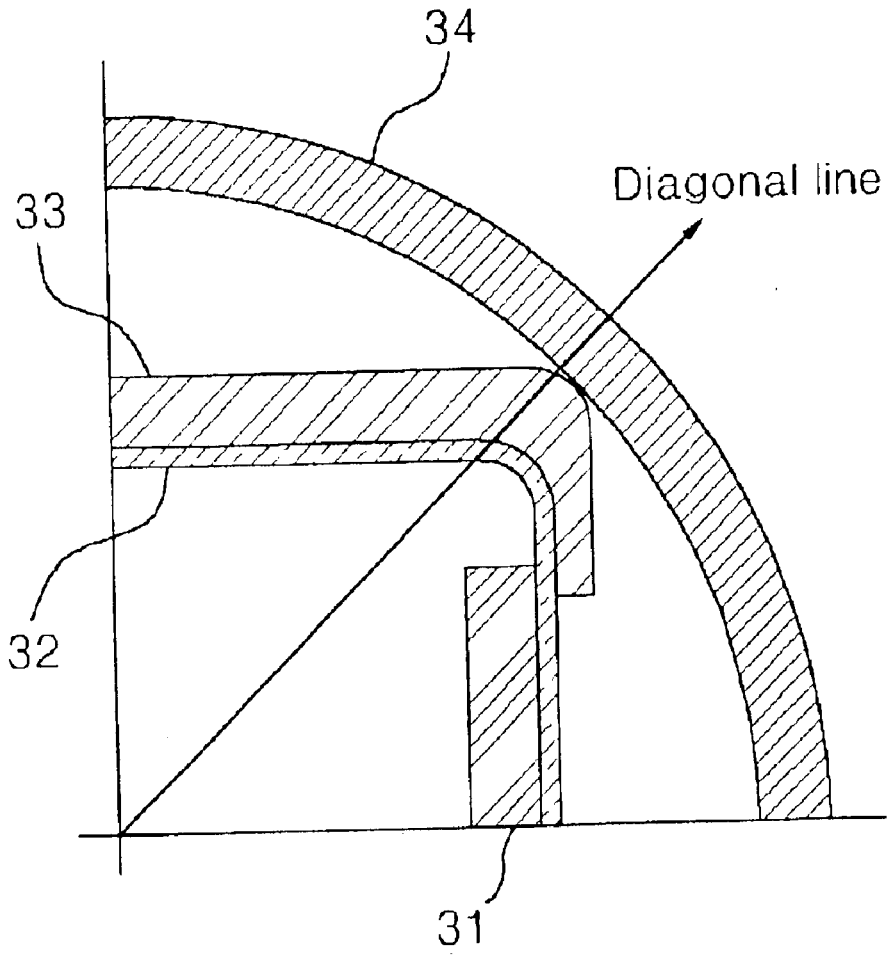
FIG. 3a (Related Art)
FIG. 3*a* is a cross-sectional view of a conventional deflection yoke including a deflection coil whose cross-section is a rectangular shape and a rectangular shape of ferrite core.
Figure 3B:
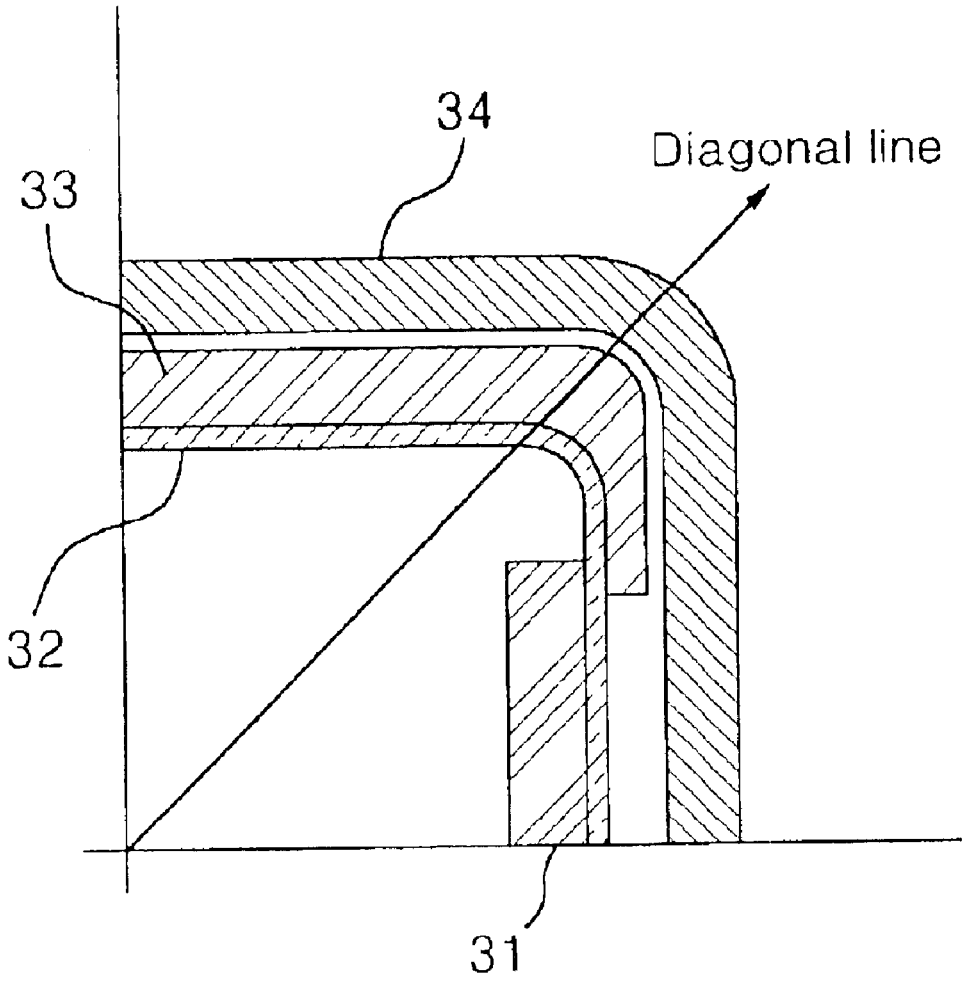
FIG. 3b (Related Art)
FIG. 3*b* a cross-sectional view showing a deflection coil whose cross-section is a rectangular shape and a circular ferrite core.
Figure 4:
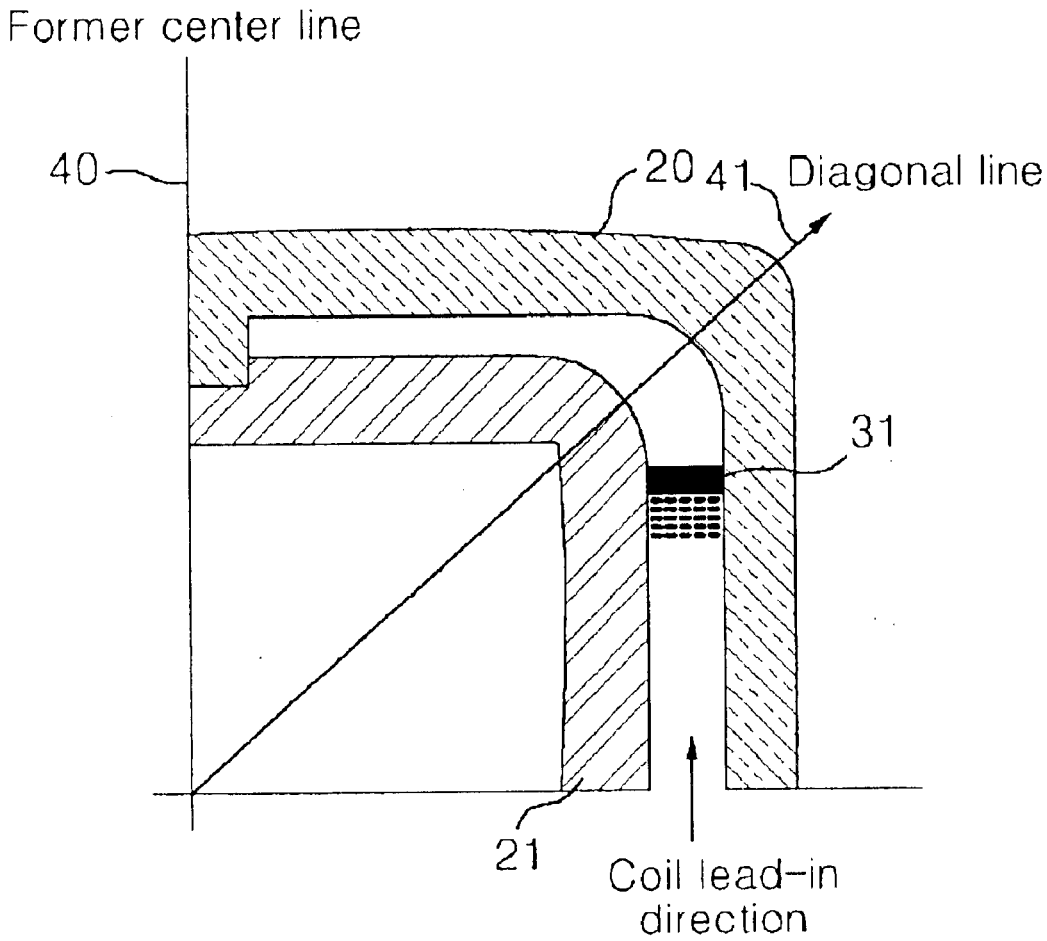
FIG. 4 (Related Art)
FIG. 4 a cross-sectional view showing a winding of a conventional horizontal deflection coil whose cross-section is a rectangular shape.
Figure 5:
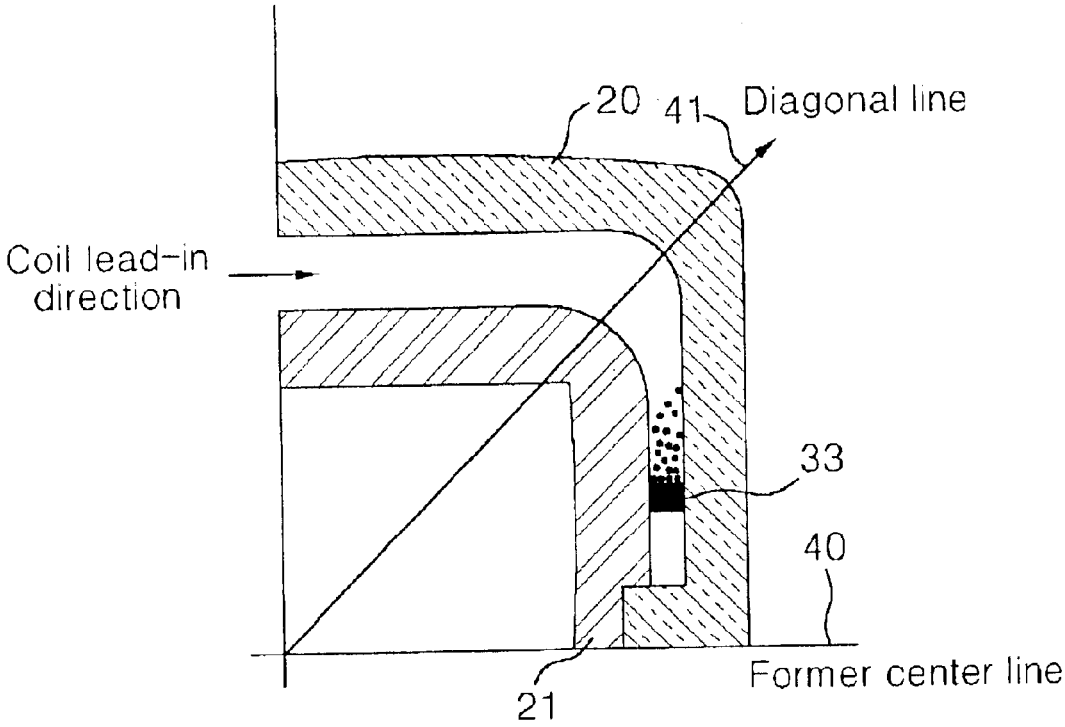
FIG. 5 (Related Art)
FIG. 5 shows a winding of a conventional vertical deflection coil whose cross-section is a rectangular shape.
Figure 6:
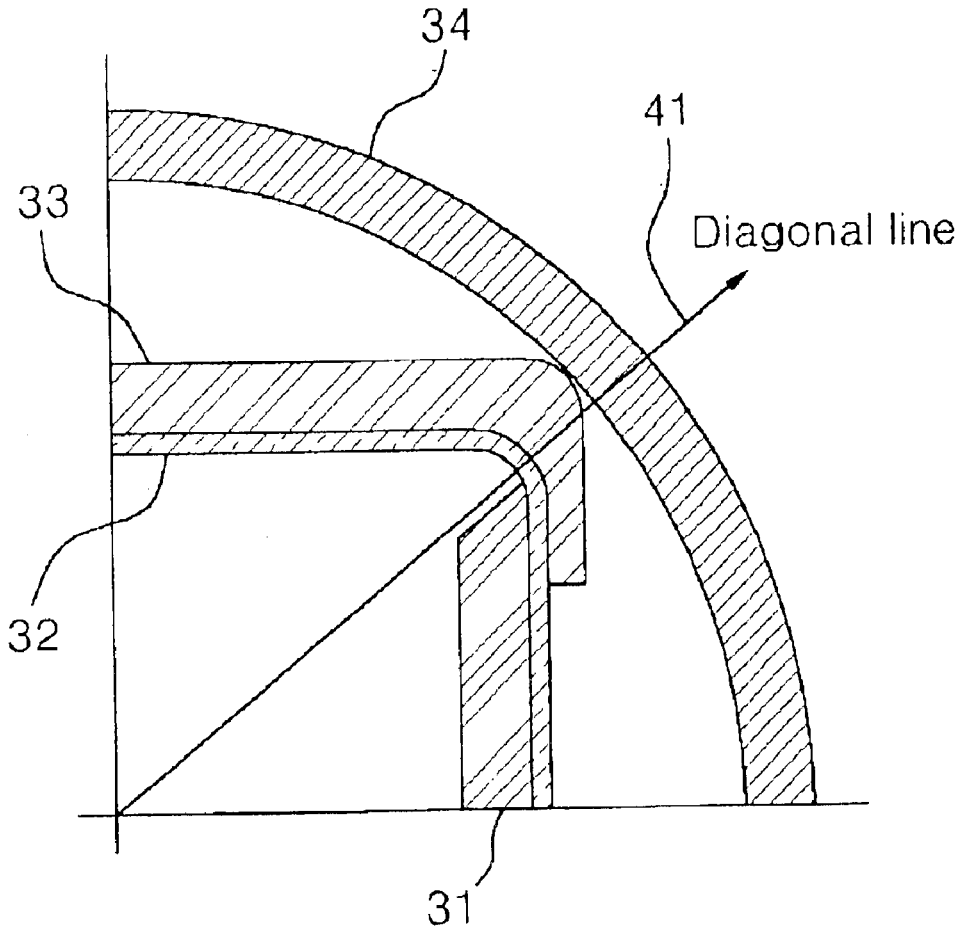
FIG. 6 (Related Art)
FIG. 6 is a cross-sectional diagram of a deflection yoke in a cathode ray tube having a screen ratio of 16:9.

In other words, because the holder 32 and the vertical deflection coil 33 are separated by a predetermined gap, differing from the conventional art in which the vertical deflection coil is bended and leaded-in almost perpendicularly in the vicinity of the diagonal line 41 as shown in FIG. 6, the present vertical deflection coil is gently bended and leaded-in in the vicinity of the diagonal line 41 by gradually reducing a lead-in angle from the entrance to which the vertical deflection coil 33 is leaded-in.

Thus, because the former surface is bended gently in the vicinity of the diagonal line 41, frictional force generated is minimal, thereby improving a lead-in capability of the vertical deflection coil.

In order to achieve the advantage described above, the distance X from the outer part of the holder 32 to the inner surface of the vertical deflection coil 33 on the vertical axis satisfies a relationship of $0<X<Y-Z$ as shown in FIG. 8.

Still another problem arises as the value of the distance X from the outer part of the holder 32 to the inner surface of the vertical deflection coil 33 on the vertical axis is changed from 0 to Y−Z. More particularly, when the electron beams are in more distant places from the vertical deflection coil 33, a vertical deflection sensitivity is deteriorated.

Therefore, to improve the lead-in capability of the vertical deflection coil 33, the deterioration of the vertical deflection coil must be considered.

FIG. 10 is a chart illustrating aggravation levels of vertical deflection energy when the distance X from the outer surface of a holder to the inner surface of the vertical deflection coil is changed on the vertical axis of the cathode ray tube in accordance with the present invention.

Referring to FIG. 10, suppose that the vertical deflection coil 33 is in a contact state with the holder 32 and that the vertical deflection energy, an electrical resistance and a rectangular of a current are 100%, respectively. Then, as the value of X is increased from 0 to Y−Z, the electrical resistance, the rectangular of the current and the vertical deflection energy are increased all together.

That is, as the electrical resistance and the current are increased, the deflection sensitivity gets worse.

Therefore, it is desirable that $X/(Y-Z)$ is smaller than 0.7 with considering the deflection sensitivity of the vertical deflection coil and the productivity of the vertical deflection coil.

That is, it is desirable that X/(Y−Z) satisfies a relationship of 0<X/(Y−Z)<0.7.

It is possible that the productivity of the vertical deflection coil is maximized, while minimizing the deterioration of the deflection sensitivity, by making the above conditions satisfied.

In addition, as described in reference to FIG. 6, because upon manufacturing the vertical deflection coil, the frictional force generated in case of the screen ratio of 16:9 is greater than that generated in case of the screen ration of 4:3, it is desirable that X/(Y−Z) is smaller than 0.8 with considering the deflection sensitivity of the vertical deflection coil and the productivity of the vertical deflection coil.

That is, it is desirable that X/(Y−Z) satisfies a relationship of 0<X/(Y−Z)<0.8.

Figure 11:
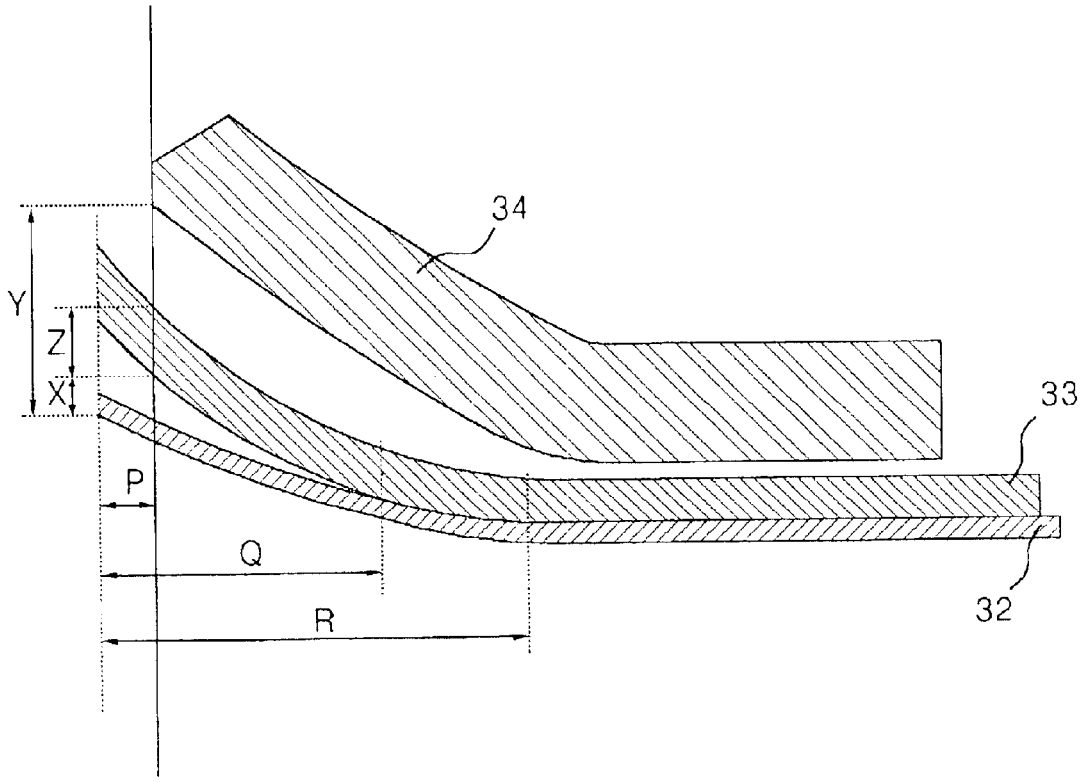
FIG. 11 is a cross-sectional diagram of the deflection yoke taken along a plane consisting of the axis direction of an electron gun and the vertical axis direction of a screen, in the cathode ray tube in accordance with the present invention.

Referring to FIG. 11, assuming that the distance from the opening end of the vertical deflection coil 33 to the linear part beginning of the vertical deflection coil 33 on the vertical axis is defined as R, the distance from the opening end of the vertical deflection coil 33 to a point which has no distance with the holder 32 is defined as Q, and the distance from the opening end of the vertical deflection coil 33 to the opening end of the ferrite core 34 is defined as P, Q value can be represented as follows.

$$0<Q<R$$

However, it is desirable that Q has a relationship of P<Q<R in order to improve the vertical deflection sensitivity and the lead-in capability of the vertical deflection coil 33.

Figure 12:
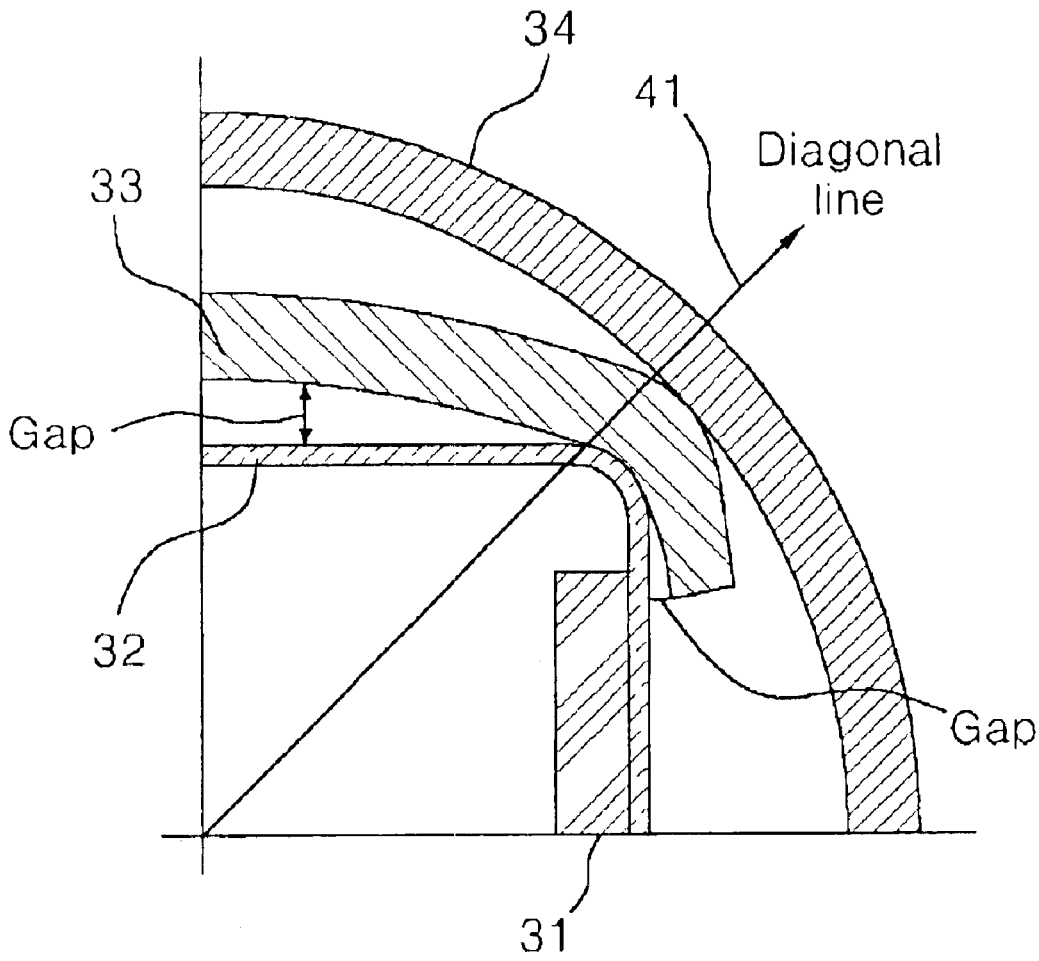
FIG. 12 is a diagram showing an alternative embodiment of a cathode ray tube in accordance with the present invention.

FIG. 12 is a diagram showing an alternative embodiment of a cathode ray tube in accordance with the present invention.

Referring to FIG. 12, the vertical deflection coil 33 is formed in such a manner that the vertical deflection coil 33 is separated from a holder 32 by a predetermined gap beneath a diagonal line 41.

Differing from the above description in reference to FIG. 8, as the vertical deflection coil is separated from the holder by the predetermined gap beneath the diagonal line 41, an angle with which the vertical deflection coil is leaded-in from the upper part of the diagonal line 41 is reduced, thereby further improving the lead-in capability of the vertical deflection coil.

As apparent from the above description, to solve a problem that because upon winding, the former surface is subjected to a greater frictional force than that of the circular coil, a lead-in capability of the deflection coil becomes poor, the cathode ray tube according to the present invention satisfies a high deflection sensitivity and a high productivity of the deflection coil as well as improves the lead-in capability by using a rectangular cross-section of deflection coil to make the deflection coil separated from the holder by the predetermined gap.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A cathode ray tube having a deflection yoke, comprising:

a horizontal deflection coil for deflecting an electron beam emitted from an electron gun in a horizontal direction;

a vertical deflection coil for deflecting the electron beam in a vertical direction;

a ferrite core for preventing a loss of a magnetic force generated from the horizontal deflection coil and the vertical deflection coil while improving a magnetic efficiency; and a holder for fixing the horizontal deflection coil, the vertical deflection coil and the ferrite core at predetermined locations and forming insulation in between the horizontal deflection coil and the vertical deflection coil, wherein each cross-section of the horizontal deflection coil and the vertical deflection coil has a rectangular shape, and a cross-section of the ferrite core has a circular shape, and the distance from the outer part of the holder to the inner surface of the vertical deflection coil on the vertical axis satisfies a relationship of 0<X<Y−Z, where a distance from an outer part of the holder to an inner surface of the ferrite core on a vertical axis of a cross-section of the deflection yoke taken along a plane parallel to a panel from an opening end of the ferrite core is defined as Y, a distance from the outer part of the holder to the inner surface of the vertical deflection coil on the vertical axis is defined as X, and a thickness of the vertical deflection coil on the vertical axis is defined as Z.

2. The cathode ray tube according to claim 1, wherein X/(Y−Z) satisfies a relationship of 0<X/(Y−Z)<0.7 on the cross-section of the deflection yoke, where a distance from an outer part of the holder to an inner surface of the ferrite core on a vertical axis of a cross-section of the deflection yoke taken along a plane parallel to a panel from an opening end of the ferrite core is defined as Y, a distance from the outer part of the holder to the inner surface of the vertical deflection coil on the vertical axis is defined as X, and a thickness of the vertical deflection coil on the vertical axis is defined as Z.

3. The cathode ray tube according to claim 2, wherein when a screen ratio is 16:9, X/(Y−Z) satisfies a relationship of 0<X/(Y−Z)<0.8 on the cross-section of the deflection yoke, where a distance from an outer part of the holder to an inner surface of the ferrite core on a vertical axis of a cross-section of the deflection yoke taken along a plane parallel to a panel from an opening end of the ferrite core is defined as Y, a distance from the outer part of the holder to the inner surface of the vertical deflection coil on the vertical axis is defined as X, and a thickness of the vertical deflection coil on the vertical axis is defined as Z.

4. The cathode ray tube according to claim 3, wherein the distance from the opening end of the vertical deflection coil to a point which has no gap with the holder satisfies the following relationship:

$$P<Q<R:$$

where R is the distance from the opening end of the vertical deflection coil to the linear part beginning of the vertical deflection coil on the vertical-section of the deflection yoke, Q is the distance from the opening end of the vertical deflection coil to a point which has no gap with the holder, and P is the distance from the opening end of the vertical deflection coil to the opening end of the ferrite core.

5. The cathode ray tube according to claim 1, wherein the distance from the opening end of the vertical deflection coil to a point which has no gap with the holder satisfies the following relationship:

$$0<Q<R$$

where R is a distance from the opening end of the vertical deflection coil to a linear part beginning of the vertical deflection coil on a vertical-section of the deflection yoke taken along a plane consisting of an axis direction of the electron gun and a vertical axis direction of a screen, Q is a distance from the opening end of the vertical deflection coil to a point which has no gap with the holder.

6. The cathode ray tube according to claim 5, wherein the distance from the opening end of the vertical deflection coil to a point which has no gap with the holder satisfies the following relationship:

$$P<Q<R:$$

where R is the distance from the opening end of the vertical deflection coil to the linear part beginning of the vertical deflection coil on the vertical-section of the deflection yoke, Q is the distance from the opening end of the vertical deflection coil to a point which has no gap with the holder, and P is the distance from the opening end of the vertical deflection coil to the opening end of the ferrite core.

7. A cathode ray tube having a deflection yoke, comprising:

a horizontal deflection coil for deflecting an electron beam emitted from an electron gun in a horizontal direction;

a vertical deflection coil for deflecting the electron beam in a vertical direction;

a ferrite core for preventing a loss of a magnetic force generated from the horizontal deflection coil and the vertical deflection coil while improving a magnetic efficiency; and a holder for fixing the horizontal deflection coil, the vertical deflection coil and the ferrite core at predetermined locations and forming insulation in between the horizontal deflection coil and the vertical deflection coil, wherein each cross-section of the horizontal deflection coil and the vertical deflection coil has a rectangular shape and a cross-section of the ferrite core has a circular shape, and on a cross-section of the deflection yoke taken along a plane parallel to a panel from the opening end of the ferrite core, the vertical deflection coil is separated by a predetermined gap from the holder in a vertical direction in an upper part of a diagonal line of the cross-section, and is separated by a predetermined gap from the holder in a horizontal direction beneath the diagonal line.

* * * * *